US005382354A

United States Patent [19]

Ansquer et al.

[11] Patent Number: 5,382,354

[45] Date of Patent: Jan. 17, 1995

[54] PROCESS FOR THE FIXED-BED SWEETENING OF SOUR PETROLEUM DISTILLATES WITH FRACTION TEMPERATURES OF FROM ABOUT 125 TO ABOUT 350 DEGREES C.

[75] Inventors: Patrick Ansquer, Lillebonne; Jean-Michel Orgebin, Saint-Adresse, both of France

[73] Assignee: Total Raffinage Distribution S.A., Levallois Perret Cedex, France

[21] Appl. No.: 753,114

[22] Filed: Nov. 13, 1991

[30] Foreign Application Priority Data

Sep. 3, 1990 [FR] France ..... 90 10942

[51] Int. Cl.[6] ..... C10G 27/10; C10G 29/00

[52] U.S. Cl. ..... 208/207; 208/189

[58] Field of Search ..... 208/189, 207

[56] References Cited

U.S. PATENT DOCUMENTS

| | | | |
|---|---|---|---|
| 4,794,097 | 12/1988 | Marty et al. | 502/163 |
| 5,026,474 | 6/1991 | Blondeau et al. | 208/189 |
| 5,069,777 | 12/1991 | Orgebin et al. | 208/207 |

FOREIGN PATENT DOCUMENTS

| | | |
|---|---|---|
| 0013257 | 7/1980 | European Pat. Off. . |
| 0252853 | 1/1988 | European Pat. Off. . |
| 0312343 | 4/1989 | European Pat. Off. . |
| 0376774 | 7/1990 | European Pat. Off. . |
| 2123846A | 2/1984 | United Kingdom . |
| 2153380A | 8/1984 | United Kingdom . |

OTHER PUBLICATIONS

Patent Abstracts of Japan, unexamined applications; C Field, vol. 12, No. 496; Dec. 23, 1988, p. 104 c 555 of Kokai, JP 63-207865 (Gosei Senriyou Gijutsu Kenkyu Kumiai).

*Primary Examiner*—Paul Lieberman
*Assistant Examiner*—Lorna M. Douyon
*Attorney, Agent, or Firm*—A. Thomas S. Safford

[57] ABSTRACT

A process for the fixed-bed sweetening of sour petroleum distillates with fraction temperatures of from about 125° to about 350° C. and having an acid number of 0.03 mg of KOH/g or higher. The reduction of the acidity and the oxidation of the mercaptans necessary for the sweetening of the distillates are carried out together in a single stage by passing the distillate, in the presence of an oxidizing agent but in the absence of a basic solution, and particularly of an alkali-metal hydroxide solution, over an oxidation catalyst whose specific surface ranges from 1 to 10 $m^2$/gram, and preferably from 2 to 6 $m^2$/gram, and whose micropore volume ranges from 0.01 to 0.10 $cm^3$/gram, and preferably from 0.02 to 0.05 $cm^3$/gram.

21 Claims, 1 Drawing Sheet

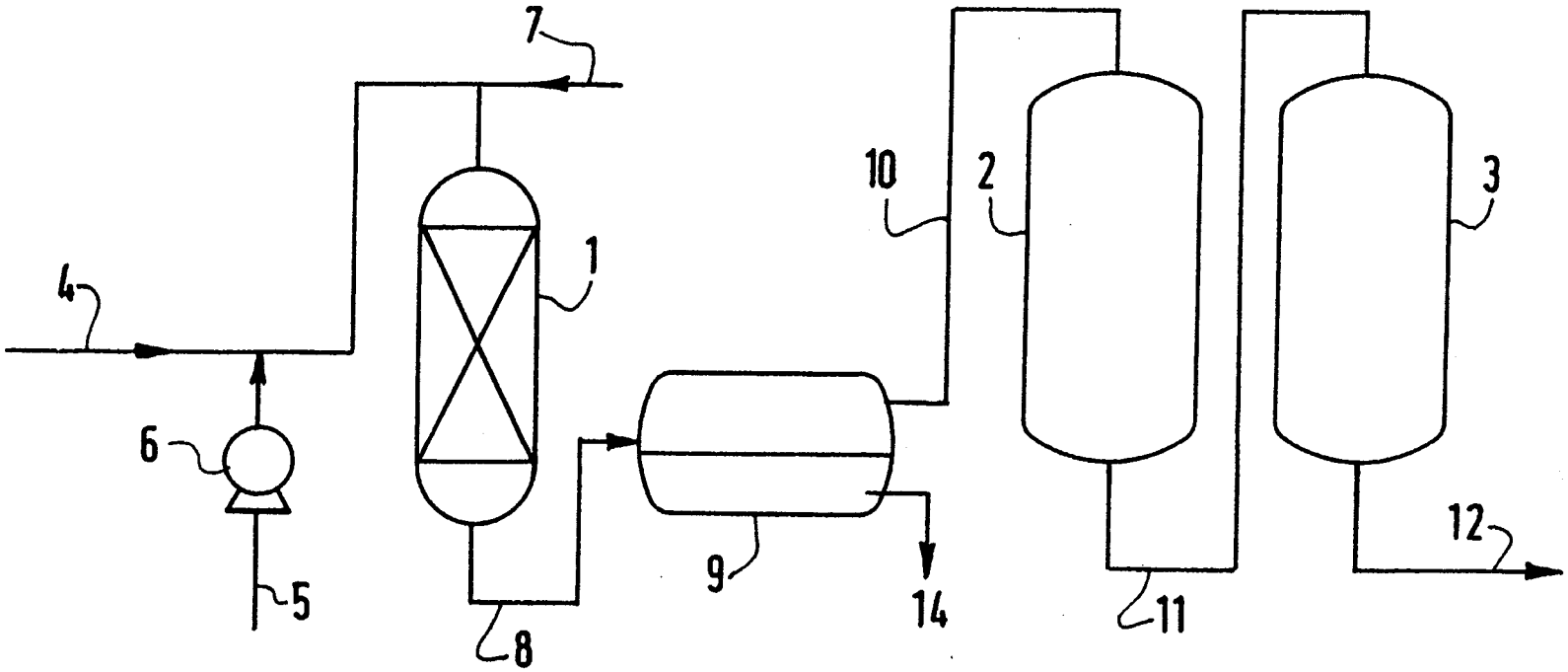
3
12
11
2
10
14
9
7
1
8
5
6
4

PROCESS FOR THE FIXED-BED SWEETENING OF SOUR PETROLEUM DISTILLATES WITH FRACTION TEMPERATURES OF FROM ABOUT 125 TO ABOUT 350 DEGREES C.

The present invention relates to a process for the fixed-bed sweetening of sour petroleum distillates with fraction temperatures of from about 125° to about 350° C. This process is intended especially for the sweetening of distillates, and more particularly of kerosenes, with an acid number higher than 0.03 mg of KOH per gram, in which case it is difficult to obtain by conventional processes distillates meeting the required use specifications, especially for the acid number, the mercaptan content, and the color.

The acidity of distillates is measured by an acid number which is determined in conformity with ASTM standard D 3242 and which in effect corresponds to the acidity added by the presence of naphthenic and carboxylic acids and of the phenol compounds in these distillates.

With conventional processes, it is customary to sweeten very sour petroleum distillates in three distinct stages.

The first stage consists in reducing the acidity of the distillates at least partially before the mercaptan oxidation reaction, either by prewashing them with basic solutions for the purpose of solubilizing in an aqueous medium the acids and the phenol compounds which generate catalyst poisons, or by filtering them in order to trap these acids or these phenol compounds on the filter and thus purify the distillates. This stage is well described in U.S. Pat. Nos. 3,398,086, 4,033,860 and 4,121,999 and in French patent 2,392,103.

The second stage consists of oxidizing the mercaptans still present in these distillates by contacting them with a metal phthalocyanine deposited on a support, with an oxidizing agent, and with a basic and often alkaline solution with a pH that is generally between 9 and 14.

The third stage involves a finishing treatment of the sweetened distillates which comprises washing with water for extracting from them the residual alkaline compounds and possibly certain soluble salts of oxidation products of residual phenol compounds, then drying them by passing them through a salt filter, and decolorizing them by passing them through a clay filter which retains the color-producing oxidation products still present.

Most of the sweetening processes employed in the industry use soda in the first and second treatment stages. (See Proceedings of the NPPA, Annual Meeting, Mar. 24–26, 1985, San Antonio, Tx.) However, the use of soda is accompanied by constraints attending a unit comprising three treating sections and the production of used soda, which has to be neutralized or discharged to other units. Up to now, the practice has been to reinject the used sodas coming from sweetening units into the desalted crude petroleum ahead of the distillation unit, but such reuse is becoming steadily less advisable since sodium, which is a poison for most catalysts used in refining, and particularly for catalytic cracking catalysts, will concentrate in atmospheric residue. Moreover, the supported catalysts used in these soda sweetening processes are known to become readily fouled, which contributes to a diminution of their activity so that they have to be regularly washed with water to reactivate them. However. such washing operations either entail an interruption of treatment or require the presence of standby reactors, which adds to the cost of the treatment of the distillates.

With a view to eliminating the problems posed by the use of soda, numerous processes for sweetening without soda have been developed, as described, for example, in U.S. Pat. Nos. 4,498,978, 4,574,121, 4,498,977, 4,207,173, 4,290,916, 4,364,843 and 4,502,949. Notwithstanding the potential appeal of such processes, the first treatment stage (that is, prewashing with soda or filtration for the purpose of removing most of the mercaptans, of the acids, and particularly of the phenol compounds, which account for much of the acidity of the distillates) continues to be essential for the high-acidity kerosenes. The implementation of this stage also makes it possible to obtain the required acidity as well as the mercaptan content desired for the sweetened distillate. Moreover, this stage makes it possible to prevent the deposition of these products and their oxides on the supported catalyst, and hence to extend its service life.

However, it has been found that when very sour distillates are to be treated, this first treatment stage is not always sufficient for attaining the acidity, mercaptan-content, and color specifications required for the marketing of these distillates.

The present invention thus seeks to provide a sweetening process which permits the industrial treatment of distillates, and particularly of kerosenes with a high acid number, with greater ease, in the absence of basic solutions such as soda in any one of the stages of the treatment, with a view to obtaining simultaneously the acidity, mercaptan-content, and color characteristics desired for the sweetened distillates.

The present invention further seeks to reduce the number of treatment stages, and hence the number of reactors, while reducing the number of shutdowns of the unit for washing the deposits off the supported catalyst.

A preferred embodiment of the present invention thus is a process for the sweetening of sour petroleum distillates, with fraction temperatures ranging from about 125° to about 350° C., whose acid number is 0.03 mg of KOH per gram or higher, characterized in that the reduction of the acidity and the oxidation of the mercaptans necessary for the sweetening of these distillates are carried out together in one stage by passing these distillates, in the presence of an oxidizing agent but in the absence of a basic solution, and particularly of an alkali-metal hydroxide solution, over an oxidation catalyst with a specific surface of from 1 to 10 $m^2/g$, and preferably from 2 to 6 $m^2/g$, and a micropore volume of from 0.01 to 0.10 $cm^3/g$, and preferably from 0.02 to 0.05 $cm^3/g$.

The applicants have found that with the process of the invention, that is, in the absence of any basic solution, the acidity of the distillate unexpectedly diminishes considerably during its passage over the catalyst bed. The acids are neutralized and the phenol compounds are oxidized at the same time as the mercaptans, yet the products resulting from this neutralization of the acids and from this oxidation of the phenol compounds do not deposit on the active sites of the catalyst but pass through the catalyst bed and end up in the sweetened distillate. Consequently, the oxidation of the mercaptans is facilitated since the activity of the catalyst is not altered. Because of the absence of an alkaline solution, washing the sweetened distillate with water in a subsequent stage is unnecessary. The distillate may be directly dried on a salt filter and then decolorized by retention of the color-producing compounds from the neutralization of the acids and the oxidation of the phenol compounds on a clay filter so that its mercaptan content and its color meet the specifications required for its marketing.

The surface properties of the support of the oxidation catalyst permit these compounds, which up to now have been regarded as poisons for the catalyst, to pass through the support. Another unexpected advantage of the invention thus is that the frequency of the periodic operations of washing the catalyst to restore its activity is reduced since the active sites are no longer covered with deposits. Moreover, such a process not only permits the number of reactors to be reduced but also enables the operator to reduce the capacity of the sweetening reactor by operating at an hourly space velocity at least two times faster than the one used in conventional processes.

In the process of the invention, a preferred oxidation catalyst consists of a solid absorbent support impregnated with a metal chelate which comprises from 0.05 to 5 percent by weight of metal chelate, from 5 to 35 percent by weight of pyrolized carbon and from 60 to 90 percent by weight of a mineral matrix whose hydration rate ranges from 1 to 20 percent, and preferably from 2 to 10 percent. In a preferred form of the invention, the metal chelate is a cobalt phthalocyanine.

To improve the treatment in accordance with the process of the invention of distillates having a high acid number of over 0.03 mg of KOH per gram, the phase of acidity reduction and mercaptan oxidation should be conducted at a temperature of from 30° to 80° C., and preferably from 35° to 45° C., in the presence of an oxidizing agent corresponding to an oxygen supply to the reactor of from 0.9 to 2 times, and preferably from 1 to 1.4 times, the quantity required for a stoichiometric reaction, at a pressure of from 1 to 30 bars, and preferably from 2 to 15 bars, and at an hourly space velocity of from 0.5 to 6, and preferably from 1 to 4, v/v/h (volume per volume per hour). For the catalyst used, an excess of oxygen over the stoichiometrically required quantity is necessary particularly in the case of distillates with a high acid number; however, this measure is preferably combined with the temperature and the space velocity of the reaction in order to prevent a deterioration of the color of the distillates sweetened by the process of the invention.

The distillates treated by this process usually have a desiccating effect on the supported catalyst which in the long run will deactivate the catalyst. This is the case particularly with the catalyst described in European patent 252,853 and its equivalent U.S. Pat. No. 4,794,474. To counteract this deactivation by drying, the applicants have chosen to add water to the catalyst, continuously or discontinuously, preferably by injection of water into the distillate to be treated before its entry into the reactor, with a view to maintaining its hydration rate at from 1 to 20 percent. In the case of continuous injection, from 100 to 500 ppm of water should introduced into the distillate. In the case of discontinuous injection, the quantity of water injected should be from 0.05 to 0.20 times the volume of catalyst loaded into the reactor, and this should be done during a short period of time ranging from 10 to 30 minutes, and without stopping the sweetening reaction, contrary to the conventional processes.

The process of the invention permits the acid number to be reduced by from 50 to 100 percent in the case of distillates whose initial acid number is higher than 0.03 mg of KOH/g. This will be the case particularly with kerosenes from the distillation of crude petroleums such as Zuluf and heavy Iranian, for which the stages of prewashing with soda and washing with water in accordance with the known processes have up to now been essential for obtaining sweetened distillates meeting the specifications required for marketing.

If such a process lends itself to the treatment of distillates whose acid number is higher than 0.03 mg of KOH Der gram, it is obviously applicable under comparable conditions. that is, in the absence of prewashing with soda and of washing with water, to the treatment of distillates of lower acidity derived, for example, from light Arabian crude petroleum.

BRIEF DESCRIPTION OF THE DRAWINGS

In this specification and in the accompanying drawings, I have shown and described preferred embodiments of my invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

FIG. 1 diagrammatically shows a preferred embodiment which may be used to practice the invention in an industrial unit.

This unit comprises a reactor 1 in which the fixed bed of oxidation catalyst is installed, a salt filter 2 for drying the sweetened distillate, and a clay filter 3 for decolorizing it.

The reactor 1 is supplied at its top by a distillate delivery pipe 4, a water delivery pipe 5 in which a pump 6 for controlling the quantity of water to be injected, continuously or discontinuously, is advantageously installed, and a pipe 7 for injection of air or of an oxidizing agent.

An outlet pipe 8 for the sweetened distillate in the bottom of the reactor 1 leads to a settler 9 designed for the removal of the water through a line 14. A pipe 10 conducts the sweetened distillate to the top of the salt filter 2, and a pipe 11 carries it to the top of the clay filter 3. The latter is provided at its bottom with a line 12 for the discharge of the sweetened distillate meeting the specifications required for its marketing.

The example which follows will serve to illustrate the process in accordance with the invention and is not intended to limit it.

EXAMPLE

The purpose of this example is to examine the performance of the process of the invention, called process A, and of a conventional three-stage process using soda, called process T (the control process).

Three different types of kerosene with a fraction temperature of from 150° to 240° C. and an acid number of from 0.006 to 0.050 mg of KOH/g are used. These kerosenes are derived from the distillation of light Arabian, Zuluf, and heavy Iranian crude petroleums.

The catalysts used in the processes A and T will be called catalyst A and catalyst T, respectively. Their characteristics are given in Table 1 which follows.

TABLE 1

| Characteristics | Catalyst A | Catalyst T |
|---|---|---|
| Specific surface ($m^2/g$) | 4 | 300 |
| Micropore volume ($cm^3/g$) | 0.03 | 0.3 |
| Cobalt phthalocyanine (wt. %) | 0.25 | 0.5 |
| Carbon (wt. %) | 8 | 95 |
| Mineral matter (wt. %) | 87 | 5 |
| Water (wt. %) | 5 | — |

These catalysts are used in the processes A and T under comparable operating conditions, summarized in Table 2 which follows. The oxidizing agent is oxygen from the air.

TABLE 2

| | Process A | Process T |
|---|---|---|
| (1) Soda pretreatment: | None | |
| Temperature (°C.) | | 40 |
| Hourly space velocity (v/v/h) | | 0.9 |
| Caustic soda (g/l) | | 15 |
| (2) Sweetening: | | |
| Temperature (°C.) | 40 | 40 |
| Pressure (bars) | 6 | 6 |
| Air flow rate (times that required stoichiometrically)* | 1.15 | 2 |
| Caustic soda (g/l)** | — | 60 |
| (3 Finishing treatment: | | |
| Washing with water | None | Yes |
| Salt filter | Yes | Yes |
| Clay filter | Yes | Yes |

*Relative to the oxygen contained in the air.
**Concentration of soda solution.

The performance of each of these processes has been measured on the basis of its efficiency in the treatment of the mercaptans and of the acidity of the feedstock, but also on the basis of the quality of the finished kerosenes, that is of their Saybolt color, as determined in conformity with ASTM standard D 3242, which should be better than +20.

The characteristics of the kerosenes, before and after treatment by the processes A and T, are given in Table 3 which follows.

TABLE 3

| Origin of Kerosenes | Entering feedstock: Mercaptan content, ppm | Entering feedstock: Acid number mg KOH/g | Sweetening conditions (v/v/h) | Finished products: Mercaptan content ppm | Finished products: Acid number mg KOH/g | Finished products: Saybolt color |
|---|---|---|---|---|---|---|
| Light Arabian | | | | | | |
| A | 130 | 0.020 | 3.0 | 7 | 0.004 | +24 |
| T | 130 | 0.020 | 1.3 | 7 | 0.004 | +22 |
| Zuluf | | | | | | |
| A | 80 | 0.030 | 3.0 | 7 | 0.004 | +23 |
| T | 80 | 0.030 | 1.3 | 7 | 0.003 | +23 |
| Heavy Iranian | | | | | | |
| A | 170 | 0.050 | 1.1 | 10 | 0.005 | +20 |
| T | 170 | 0.050 | 0.6 | 10 | 0.004 | +19 |

A = Process A, T = Process T

It is apparent from this table that, with respect to the three crude petroleums treated, process A results in a reduction of the acidity and of the mercaptan content, and in a color of the sweetened distillate that is as good as that obtained with process T, but at twice as fast an hourly space velocity and with fewer treatment stages (no prewashing with soda, and no washing with water of the sweetened product), without the use of soda, and hence without the problems attending its recycling. Being able to operate at an hourly space velocity that is twice as fast in process A than in process T enables the operator to reduce the capacity of the sweetening reactor. These advantages are substantial especially when very sour distillates derived from heavy Iranian and from Zuluf crudes are being treated.

We claim:

1. A process for the fixed-bed sweetening of sour petroleum distillates with fraction temperatures of from about 125° to about 350° C. having an acid number of 0.03 mg of KOH/g or higher comprising a single combined stage of reduction of the acidity of and simultaneous oxidation of the mercaptans in the distillates by passing the distillate, without and prewashing in the presence of an oxidizing agent but in the absence of a basic solution, over an oxidation catalyst whose specific surface ranges from 1 to 6 $m^2$/gram and whose micropore volume ranges from 0.01 to 0.04 $cm^3$/gram.

2. The process as defined in claim 1, wherein the oxidation catalyst has a specific surface range of from 2 to 6 $m^2$/gram, and which has a micropore volume of from 0.01 to 0.04 $cm^3$/gram.

3. A process as defined in claim 1, wherein the oxidation catalyst comprises a solid absorbent support impregnated with a metal chelate, and having, in percent by weight, from 0.05 to 10 percent of metal chelate,
from 5 to 35 percent of pyrolyzed carbon, and
from 60 to 90 percent of a mineral matrix.

4. A process as defined in claim 2, wherein the oxidation catalyst comprises a solid absorbent support impregnated with a metal chelate, and having, in percent by weight, from 0.05 to 10 percent of metal chelate,
from 5 to 35 percent of pyrolyzed carbon, and
from 60 to 90 percent of a mineral matrix.

5. A process as defined in claim 3, wherein the metal chelate is a cobalt phthalocyanine.

6. A process as defined in claim 4, wherein the metal chelate is a cobalt phthalocyanine.

7. A process as defined in claim 1, wherein the sweetening reaction takes place at a temperature ranging from 30° to 80° C., with a quantity of air in the reactor corresponding to an oxygen supply of from 0.9 to 2 times the stoichiometric quantity required for the reaction, at a pressure ranging from 1 to 30 bars, and at an hourly space velocity of the distillate to be treated of from 0.5 to 6 v/v/h.

8. A process as defined in claim 4, wherein the sweetening reaction takes place at a temperature of from 35° to 45° C., with a quantity of air in the reactor corresponding to an oxygen supply of from 1 to 1.4 times the stoichiometric quantity required for the reaction, at a pressure ranging from 2 to 15 bars, and at an hourly space velocity of the distillate to be treated of from 1 to 4 v/v/h.

9. A process as defined in claim 1, wherein water is added continuously to the reactor at a rate sufficient effectively to rehydrate the catalyst.

10. A process as defined in claim 1, wherein water is added intermittently to the reactor at a rate sufficient effectively to rehydrate the catalyst.

11. A process as defined in claim 1, wherein water is added continuously to the reactor for the purpose of rehydrate the catalyst by dissolving said water in the distillate to be treated.

12. A process as defined in claim 1, wherein water is added intermittently to the reactor for the purpose of rehydrating the catalyst by dissolving said water in the distillate to be treated.

13. A process as defined in claim 9, wherein from 100 to 500 ppm of water is continuously injected into the distillate.

14. A process as defined in claim 10, wherein from 100 to 500 ppm of water is intermittently injected into the distillate.

15. A process as defined in claim 9, wherein a volume of water representing from 0.05 to 0.20 times the volume of the catalyst is injected for at least 30 minutes.

16. A process as defined in claim 10, wherein a volume of water representing from 0.05 to 0.20 times the volume of the catalyst is injected for at least 30 minutes.

17. A process as defined in claim 1, wherein the sweetened distillate is subjected to a finishing treatment which comprises passing the sweetened distillate through a salt filter, and then through a clay filter, without washing the distillate with water.

18. A process as defined in claim 2, wherein the sweetened distillate is subjected to a finishing treatment which comprises passing the sweetened distillate through a salt filter, and then through a clay filter, without washing the distillate with water.

19. A process for the fixed-bed sweetening of sour petroleum distillates with fraction temperatures of from about 125° to about 350° C. having an acid number of 0.03 mg of KOH/g or higher comprising a single combined stage of reduction of the acidity of and simultaneous oxidation of the mercaptans in the distillates by passing the distillate, without any prewashing, in the presence of an oxidizing agent but in the absence of a basic solution, over an oxidation catalyst which has a specific surface range of from 1 to 6 $m^2$/gram and which has a micropore volume of from 0.01 to 0.04 $cm^3$/gram and wherein the oxidation catalyst comprises a solid absorbent support impregnated with a metal chelate and having, in percent by weight, from 0.05 to 10% of metal chelate, from 5 to 35% of pyrolyzed carbon and from 60 to 90% of a mineral matrix, and wherein the sweetening reaction takes place at a temperature ranging from 30° to 80° C., with a quantity of air in the reactor corresponding to an oxygen supply of from 0.9 to 2 times the stoichiometric quantity required for the reaction, at a pressure ranging from 1 to 30 bars, and at an hourly space velocity of the distillate to be treated of from 0.5 to 6 v/v/h.

20. A process for the fixed-bed sweetening of sour petroleum distillates with fraction temperatures of from about 125° to about 350° C. having an acid number of 0.03 mg of KOH/g or higher comprising a single combined stage of reduction of the acidity of and simultaneous oxidation of the mercaptans in the distillates by passing the distillate, without any prewashing in the presence of an oxidizing agent but in the absence of a basic solution, over an oxidation catalyst which has a specific surface range of from 1 to 6 $m^2$/gram and which has a micropore volume of from 0.01 to 0.04 $cm^3$/gram and wherein the oxidation catalyst comprises a solid absorbent support impregnated with a metal chelate and having, in percent by weight, from 0.05 to 10% of metal chelate, from 5 to 35% of pyrolyzed carbon and from 60 to 90% of a mineral matrix, and wherein the sweetening reaction takes place at a temperature ranging from 35° to 45° C., with a quantity of air in the reactor corresponding to an oxygen supply of from 1 to 1.4 times the stoichiometric quantity required for the reaction, at a pressure ranging from 2 to 15 bars, and at an hourly space velocity of the distillate to be treated of from 1 to 4 v/v/h.

21. A process for the fixed-bed sweetening of sour petroleum distillates with fraction temperatures of from about 125° to 350° C. having an acid number of 0.03 mg of KOH/g or higher comprising a single combined stage of reduction of the acidity of and simultaneous oxidation of the mercaptans in the distillates by passing the distillate, without any prewashing, in the presence of an oxidizing agent but in the absence of a basic solution, over an oxidation catalyst whose specific surface ranges from 2 to 6 $m^2$/gram and whose micropore volume ranges from 0.02 to 0.04 $cm^3$/gram, and wherein the oxidation catalyst comprises a solid absorbent support impregnated with a metal chelate, and having, in percent by weight, from 0.05 to 10 percent of metal chelate,
from 5 to 35 percent of pyrolized carbon, and
from 60 to 90 percent of a mineral matrix.

* * * * *